United States Patent [19]

Anderson

[11] Patent Number: 4,956,915

[45] Date of Patent: Sep. 18, 1990

[54] SANITARY NAIL CLIPPING DEVICE

[76] Inventor: Charles A. Anderson, 1400 George, Norman, Okla. 73072

[21] Appl. No.: 360,769

[22] Filed: Jun. 2, 1989

[51] Int. Cl.[5] ..... A45D 29/00; A45D 29/18

[52] U.S. Cl. ..... 30/28; 132/73.5

[58] Field of Search ..... 30/27, 28, 284; 132/73, 132/73.5, 75.5

[56] References Cited

U.S. PATENT DOCUMENTS

| | | | |
|---|---|---|---|
| 3,774,993 | 11/1973 | Senee | 132/73.5 |
| 3,943,948 | 3/1976 | Sartore | 30/28 |
| 4,341,015 | 7/1982 | Young | 30/28 |

FOREIGN PATENT DOCUMENTS

| | | | |
|---|---|---|---|
| 2515412 | 10/1976 | Fed. Rep. of Germany | 30/28 |

*Primary Examiner*—Douglas D. Watts
*Assistant Examiner*—Paul M. Heyrana, Sr.
*Attorney, Agent, or Firm*—Laney, Dougherty, Hessin & Beavers

[57] ABSTRACT

A device for clipping fingernails and toenails which includes an enclosure having an open side facilitating insertion of a nail-carrying digital member, and having a nail clipper aperture therethrough on its opposite side from the open side. The enclosure has a transparent top panel having a portion configured as a magnifying lens. A retention element is secured to the inside of the enclosure at a location adjacent the nail clipper aperture. The nail clipper has a portion thereof carrying clipper jaws extended through the aperture into the enclosure, and there detachably engaged by the retainer element.

8 Claims, 2 Drawing Sheets

SANITARY NAIL CLIPPING DEVICE

FIELD OF THE INVENTION

This invention relates to devices for clipping fingernails and toenails, and more particularly, to a device for clipping nails so that the nails are confined, and can be easily disposed of after the clipping, and so that the clipping can be carried out with precision and in a sanitary fashion.

BRIEF DESCRIPTION OF THE PRESENT INVENTION

The present invention provides a device which is useful for clipping the fingernails and toenails accurately and with precision so that the trimmed nails are neat in appearance, and so that the operation of clipping does not cause injury to the cuticle or to the quick around the nail endings.

Broadly described, the nail clipping device of the present invention is an enclosure which is open at one side to facilitate the insertion of a finger or a toe, the nail of which is to be trimmed, through the open side of the enclosure to the interior thereof. At the side of the enclosure opposite the open side, an opening or aperture is provided through which a portion of a nail clipper can be inserted in alignment with a toe or finger placed within the enclosure by insertion. At least a part of the enclosure constituting the upper or top panel thereof is transparent so that the nail to be clipped and the nail clipper are visible from above.

In a preferred embodiment of the invention, the enclosure carries a magnifying lens as a portion of the upper panel, and this enables the nail and the jaws of the nail clipper to be magnified as the nail clipping operation is viewed from above. Within the enclosure, a retention element is provided which can engage the end portion of the nail clipper which carries the jaws. This allows the portion of the clippers which is manipulated with the fingers to remain outside the enclosure to be grasped, and the entire enclosure engaged with the clipper can be carried from one place to another for purposes of dumping nail clippings out of the open side of the enclosure.

In a preferred embodiment of the invention, the enclosure is constructed by securing a pair of rectangular panel elements to each other along lateral or opposed parallel side edges thereof. This construction has the advantage that when the digit carrying the nail to be clipped is inserted through the open side of the enclosure, the clippings of the nail tend to more surely remain in the enclosure, and also can more easily be dumped or discharged from the enclosure into a suitable receptacle, such as a wastebasket or the like.

An important object of the present invention is to provide a sanitary nail clipping device which will catch and retain the clippings of fingernails or toenails which are trimmed by the use of the device, and thus prevent these clippings from falling to the floor, or being propelled through the air at the time of clipping.

An additional object of the invention is to provide a sanitary nail clipping device which magnifies the nail to be clipped and the jaws of the clipper element at the time the clipping takes places so that more accurate and neater clipping can be effected.

A further object of the invention is to provide a nail clipping device which forms a cup or receptacle for nail clippings which are removed from the nail, and which device has an easily manipulated handle which permits the clippings to be easily dumped or discharged from the device at a later time.

A further object of the invention is to provide a sanitary nail clipping device which is relatively inexpensive in its construction, and which can be afforded by persons of modest means.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
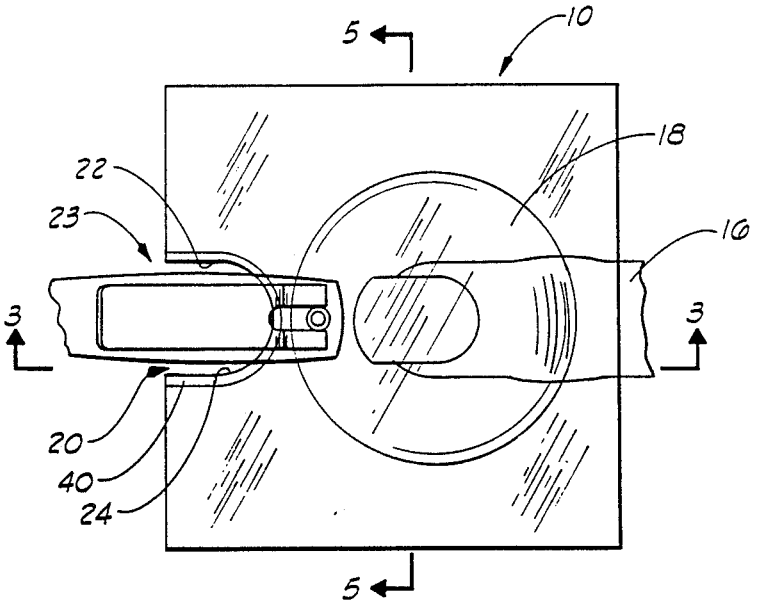
FIG. 1 is a top plan view of a sanitary nail clipping device constructed in accordance with the present invention, and showing a finger positioned for clipping a fingernail.
Figure 3:
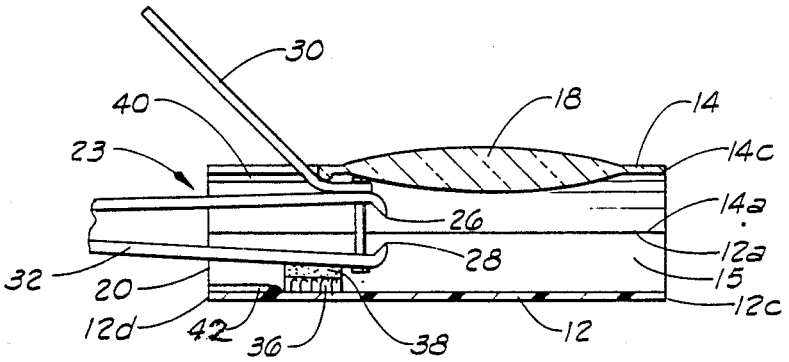
FIG. 3 is a sectional view taken along line 3—3 of FIG. 1 and showing the device with, the finger illustrated in FIG. 1 removed therefrom.
Figure 5:
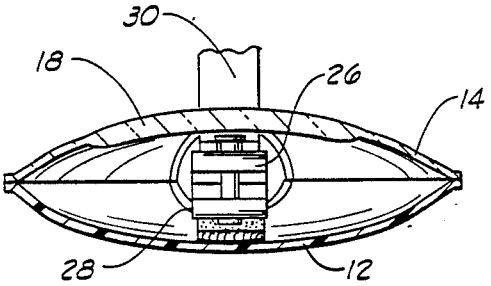
FIG. 5 is a sectional view taken along line 5—5 of FIG. 2 with the finger removed for clarity of illustration.
Figure 6:
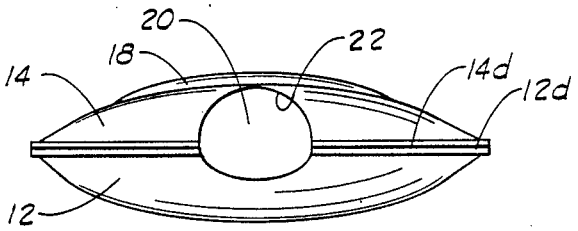
FIG. 6 is a rear elevation view of the nail clipping device with the nail clipper removed therefrom for clarity of illustration.

Referring initially to FIG. 1 of the drawings, the sanitary nail clipping device of the invention includes an enclosure designated generally by reference numeral 10. As shown in FIGS. 3 and 5, the enclosure 10 includes a substantially rectangular bottom panel 12 which is a flat sheet of material which may be transparent or opaque, and is relatively flexible. In the illustrated embodiment, the bottom panel is opaque. The bottom panel 12 has a pair of opposed, substantially parallel side edges **12*a* and 12*b* which are secured or joined by any suitable method to the opposed, substantially parallel side edges of a flexible, rectangular top panel 14** constructed of transparent material.

Figure 2:
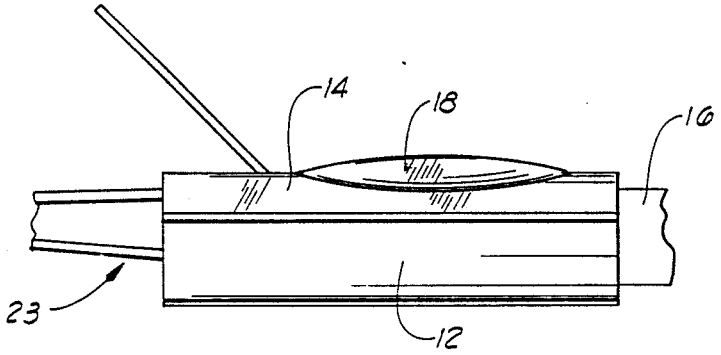
FIG. 2 is a side elevation view of the nail clipping device constructed in accordance with the invention.

The top transparent panel 14 has a pair of opposed side edges **14*a* and 14*b* which are joined to the respective side edges 12*a* and 12*b* of the bottom panel 12. An opening 15 into the enclosure 10 is formed along one side thereof, and is defined by an upper side edge 14*c* of the top panel, and a lower side 12*c* of the lower panel which extend substantially parallel to each other along the open side of the enclosure. This opening 15 facilitates the insertion of a toe or finger into the enclosure, and in FIGS. 1 and 2 of the drawings, a finger 16 is shown extended through the opening into the enclosure 10**.

The top panel 14 carries a magnifying zone 18 which is configured as a convex-convex lens. The magnifying zone 18 can be molded from the same transparent material from which the remainder of the top panel 14 is made, and the magnifying zone is, of course, transparent like the remainder of the top panel. The magnifying zone 18 functions, in a manner hereinafter described, to magnify a digital member (the toe or the finger) which is inserted through the opening at one side of the enclosure 10.

At the opposite side of the enclosure 10, an aperture or passageway 20 opens into the enclosure to allow one end of a nail clipper 23 to be inserted into the enclosure. In a preferred embodiment of the invention, the aperture 20 is defined by an indentation 22 formed in the upper panel 14. From the recess 22 outwardly to the joined side edges of the respective upper and lower panels, these panels are joined to each other along side edges 12*d* and 14*d* lying opposite the side edges 12*c* and 14*c*.

The nail clipper 23 is constructed in conventional fashion and includes a pair of opposed trimming jaws 26 and 28 and a fulcrum arm 30. In addition, the clipper 23 includes an elongated handle 32 which projects laterally from the enclosure 10 and functions as a handle for dumping the nail clippings in a manner hereinafter described.

The nail clipper 23 is detachably retained in the position illustrated in which the jaws 26 and 28 are located within the enclosure 10 by a detachable securement means. In the illustrated embodiment of the invention, the clipper 23 is detachably secured to the enclosure 10 by means of a Velcro pad 36 which is secured to the inner and upwardly facing surface of the bottom panel 12 at the illustrated location, and a cooperating Velcro pad 38 which is carried on, and secured to, the nail clipper 23 on the lower side of the handle 32 at the position illustrated in FIG. 3.

OPERATION

In the operation of the sanitary nail clipping device of the invention, the nail clipper 23 is first positioned so that the trimming jaws 26 and 28 are located inside the enclosure 10 at the illustrated position. In this position, the nail clipper 23 is retained at this location relative to the enclosure 10 by the interengagement of the Velcro pads 36 and 38. It will be apparent, of course, that this is not a permanent connection and that the nail clipper 23 can be detached from the enclosure 10 easily and when desired.

With the nail clipper 23 detachably secured to the enclosure 10 at the illustrated location, a finger or toe which is to be manicured by the trimming of the nail carried thereon is inserted through the opening 15 so that the nail is within the enclosure 10 and located directly below the magnifying zone 18. It will also be noted that the tip of the nail clipper 23 where the trimming jaws 26 and 28 are located is also positioned under the magnifying zone 18. With the toe or finger located in this position, it can then be further advanced so that the nail is extended between the trimming jaws. The fulcrum arm 30 is then depressed so as to cause the jaws 26 and 28 to converge and trim the nail in the usual fashion. By reason of the magnification of the nail, the extremity of the finger or toe, and the magnification of the trimming jaws 26 and 28, the nail can be trimmed quite precisely and neatly.

Figure 4:
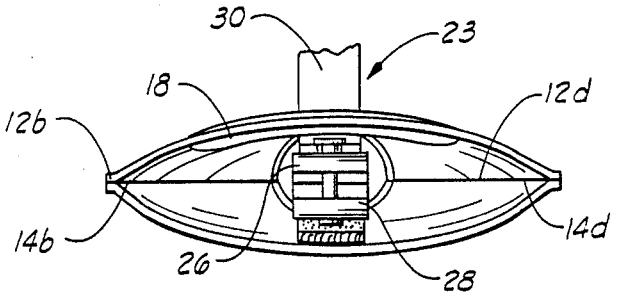
FIG. 4 is a front elevation view of the nail clipping device with the finger removed therefrom for clarity of illustration.

It will be noted in referring to FIGS. 4 and 5 that the deepest or lowest portion of the enclosure 10 is the portion immediately beneath the location where the nail is located and where the trimming occurs. The value of this construction is that trimmings from the nail are prevented from flying through the air, or falling to the floor, by the enclosure 10. The shape of the enclosure 10 assures that the nail trimmings will gravitate to the center of the enclosure, and can be easily disposed of through the opening 15 when trimming has been completed.

After trimming of the nail is completed, the finger 16 is removed. The nail trimming device can then be easily carried to a place where the nail trimmings can be disposed of. This is accomplished by simply gripping the handle of the nail clipper 23 and carrying the enclosure 10 with the nail trimmings disposed within the enclosure to the point of disposition, and then using the handle of the nail clipper 23 to dump the clippings out of the enclosure through the opening 15.

The ribs 40 and 42 which are formed around the recess 22 in the top panel 14, and also along the rear of the bottom panel 12 function to prevent any of the nail clippings from sliding out of the aperture 20 used to facilitate the insertion of the end portion of the nail clipper 23 into the enclosure.

Although a preferred embodiment of the invention has been herein described in order to permit those having ordinary skill in this art to understand and apply the principles of the invention, it will be understood that various changes and modifications in the illustrated structure can be effected without departure from the basic principles of the invention. Changes and modifications of this type are therefore deemed to be circumscribed by the spirit and scope of the invention, except as the same may be necessarily limited by the appended claims, or reasonable equivalents thereof.

What is claimed is:

1. A sanitary nail clipping device for clipping fingernails and toenails comprising:

an enclosure having an opening thereinto to facilitate the insertion of a nail-carrying digit into the enclosure;

an aperture in the enclosure opposite said opening; and a nail clipper having a jaw-carrying end portion extending through said aperture, with said jaws located within said enclosure; and means detachably engaging said nail clipper with said enclosure so that when desired, said clipper can be withdrawn from said enclosure through said aperture.

2. A sanitary nail clipping device as defined in claim 1 and further characterized as including magnifying means carried by said enclosure at a location to facilitate viewing said nail-carrying digit therethrough, and the clipping of the nail on the digit using said nail clipper.

3. A sanitary nail clipping device as defined in claim 2 wherein said enclosure includes a transparent top panel having a transparent convex-convex lens section molded integrally therein and constituting said magnifying means.

4. A sanitary nail clipping device as defined in claim 2 wherein said enclosure comprises:

a transparent top panel having a pair of opposed side edges; and a bottom panel having a pair of opposed side edges secured to the opposed side edges of said top panel; and wherein said opening is defined by a space separating said top panel and said bottom panel.

5. A sanitary nail clipping device as defined in claim 1 wherein said enclosure comprises:

a transparent top panel having a pair of opposed side edges; and a bottom panel having a pair of opposed side edges secured to the opposed side edges of said top panel, and wherein said opening is defined by a space separating said top panel and said bottom panel between the interconnected side edges thereof.

6. A sanitary nail clipping device as defined in claim 1 and further characterized as including means around said aperture for preventing nail clippings from sliding through said aperture and out of said enclosure.

7. A sanitary nail clipping device as defined in claim 6 wherein said means preventing nail clippings from sliding through said aperture comprises a protuberant rib surrounding at least a part of said aperture and projecting into the interior of said enclosure.

8. A sanitary nail clipping device as defined in claim 7 and further characterized as including magnifying means carried by said enclosure at a location to facilitate viewing said nail-carrying digit therethrough during the clipping of the nail on the digit using said nail clipper.

* * * * *